US008351570B2

(12) United States Patent
Nakamura et al.

(10) Patent No.: US 8,351,570 B2
(45) Date of Patent: Jan. 8, 2013

(54) PHASE GRATING USED TO TAKE X-RAY PHASE CONTRAST IMAGE, IMAGING SYSTEM USING THE PHASE GRATING, AND X-RAY COMPUTER TOMOGRAPHY SYSTEM

(75) Inventors: Takashi Nakamura, Yokohama (JP); Aya Imada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 203 days.

(21) Appl. No.: 12/891,891

(22) Filed: Sep. 28, 2010

(65) Prior Publication Data

US 2011/0085639 A1 Apr. 14, 2011

(30) Foreign Application Priority Data

Oct. 9, 2009 (JP) ..... 2009-234850

(51) Int. Cl.
*H05G 1/60* (2006.01)

(52) U.S. Cl. ..... 378/62; 378/145

(58) Field of Classification Search ..... 378/62, 378/2, 145, 70

See application file for complete search history.

(56) References Cited

U.S. PATENT DOCUMENTS

| | | | | |
|---|---|---|---|---|
| 5,812,629 | A * | 9/1998 | Clauser | 378/62 |
| 2007/0183560 | A1 * | 8/2007 | Popescu et al. | 378/5 |
| 2009/0120904 | A1 | 5/2009 | Imada et al. | 216/41 |
| 2010/0246764 | A1 | 9/2010 | Itoh et al. | 378/62 |

FOREIGN PATENT DOCUMENTS

| | | |
|---|---|---|
| JP | 2007-203074 | 8/2007 |

* cited by examiner

*Primary Examiner* — Hoon Song

(74) *Attorney, Agent, or Firm* — Fitzpatrick, Cella, Harper & Scinto

(57) ABSTRACT

To provide a phase grating capable of acquiring, in photographing of an X-ray phase contrast image by use of X-ray with two wavelengths, an X-ray phase contrast image by a phase grating in the same size as when a single wavelength is used, provided is a phase grating used when an X-ray is directed to take an X-ray phase contrast image, the phase grating including a periodic structure for generating a phase difference between an X-ray transmitted through the structure and an X-ray not transmitted through the structure. The periodic structure has different periods in a plurality of directions in a same surface.

7 Claims, 4 Drawing Sheets

PHASE GRATING USED TO TAKE X-RAY PHASE CONTRAST IMAGE, IMAGING SYSTEM USING THE PHASE GRATING, AND X-RAY COMPUTER TOMOGRAPHY SYSTEM

BACKGROUND OF THE INVENTION

1. Field of the Invention

The present invention relates to a phase grating used to take an X-ray phase contrast image, an imaging system using the phase grating, and an X-ray computer tomography system.

2. Description of the Related Art

Conventionally, an X-ray fluoroscopic technique for using a difference between absorption capacities of X-ray to obtain a contrast image has been studied.

However, the lighter the element is, the smaller is the absorption capacity of the X-ray. Therefore, there is a problem that enough contrast cannot be expected for soft biological tissues and soft materials.

Thus, in recent years, an imaging method for generating contrast based on a phase shift of X-ray is studied.

An example of an imaging method of X-ray phase contrast image (X-ray phase imaging method) using the phase contrast includes an imaging method using a Talbot interferometry.

An outline of the imaging method of the Talbot interferometry will be described with reference to FIG. 4.

In the imaging based on the Talbot interferometry, at least a spatial coherent X-ray source 6, a phase-type diffraction grating (hereinafter, "phase grating") 1 for periodically modulating the phase of the X-ray, and a detector 9 are necessary.

In the spatially coherent X-ray, the shape of the phase grating 1 is reflected on the X-ray intensity distribution after transmission through the phase grating 1.

In the X-ray intensity distribution, the contrast changes according to the distance from the X-ray source of the X-ray.

The phenomenon that a light/dark periodic image is periodically formed at a specific distance of grating is a Talbot effect. The light/dark periodic image will be called a self-image.

The locations where the periodic intensity patterns image are formed with the highest contrast are determined by the wavelength of the irradiated X-ray or by the pitch of the phase grating 1.

The pitch of the phase grating 1 in the specification denotes a period with aligned gratings.

As illustrated in a schematic diagram of cross section of the phase grating of FIG. 5, the period may be a distance C between center parts of a grating and an adjacent grating or may be a distance C' between end faces of the gratings.

A structure including structures parallel to each other periodically arranged at constant intervals in FIG. 5 will be called a periodic structure in the present specification.

If a subject 7 is arranged between the X-ray source and the phase grating, the directed X-ray is refracted by the subject 7.

Therefore, an X-ray phase contrast image of the subject 7 can be obtained by detecting the self-image formed by the refracted X-ray after transmission through the subject 7.

However, an X-ray detector 9 with high spatial resolution is required to detect a self-image.

When the X-ray detector 9 with high spatial resolution is not used, the X-ray phase contrast image can be acquired using an absorption grating 8 with enough thickness to provide a high contrast.

The absorption grating 8 is arranged at a location where the self-image is formed. Moire fringes are generated depending on the location relationship between the self-image and the absorption grating 8.

The phase shift resulted from the installation of the subject 7 between the X-ray source and the phase grating can be observed by the detector 9 as a change in the amount of X-ray transmitted through the absorption grating 8 or as a transformation of the moire fringes.

A phase image of the subject obtained by the method is illustrated by 0 to $2\pi$.

If a difference between amounts of phase change is $2\pi n$ (n is an integer excluding 0) when X-ray phase images of a plurality of subjects are acquired by the imaging method of the X-ray phase contrast image using X-ray with a single wavelength, the subjects cannot be distinguished.

Therefore, Japanese Patent Application Laid-Open No. 2007-203074 proposes an imaging method of an X-ray phase contrast image using X ray with two different wavelengths as illustrated in FIG. 6.

SUMMARY OF THE INVENTION

However, Japanese Patent Application Laid-Open No. 2007-203074 of the conventional example has a problem that the size of the phase grating is larger than that when X-ray with a single wavelength is used.

More specifically, in Japanese Patent Application Laid-Open No. 2007-203074, two phase gratings 1 with different pitches are arranged as illustrated in FIG. 6, and images of the same part are taken twice.

Therefore, the phase grating 1 and the absorption grating 8 need to be larger than the imaging area, and the size of the phase grating is greater than that of the imaging method of the X-ray phase contrast image based on a single wavelength.

In view of the foregoing problems, an object of the present invention is to provide a phase grating capable of acquiring, in photographing of an X-ray phase contrast image by use of X-ray with two wavelengths, an X-ray phase contrast image by a phase grating in the same size as when a single wavelength is used. Another object of the present invention is to provide an imaging system using the phase grating and an X-ray computer tomography system.

The present invention can realize a phase grating capable of acquiring, in photographing of an X-ray phase contrast image by use of X-ray with two wavelengths, an X-ray phase contrast image by the phase grating in the same size as when a single wavelength is used.

The present invention can realize an imaging device using the phase grating and an X-ray computer tomography system.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An embodiment of the present invention will now be described.

An example of configuration of a phase grating used to take an X-ray phase contrast image in the present embodiment will be described with reference to FIG. 1.

Figure 5:
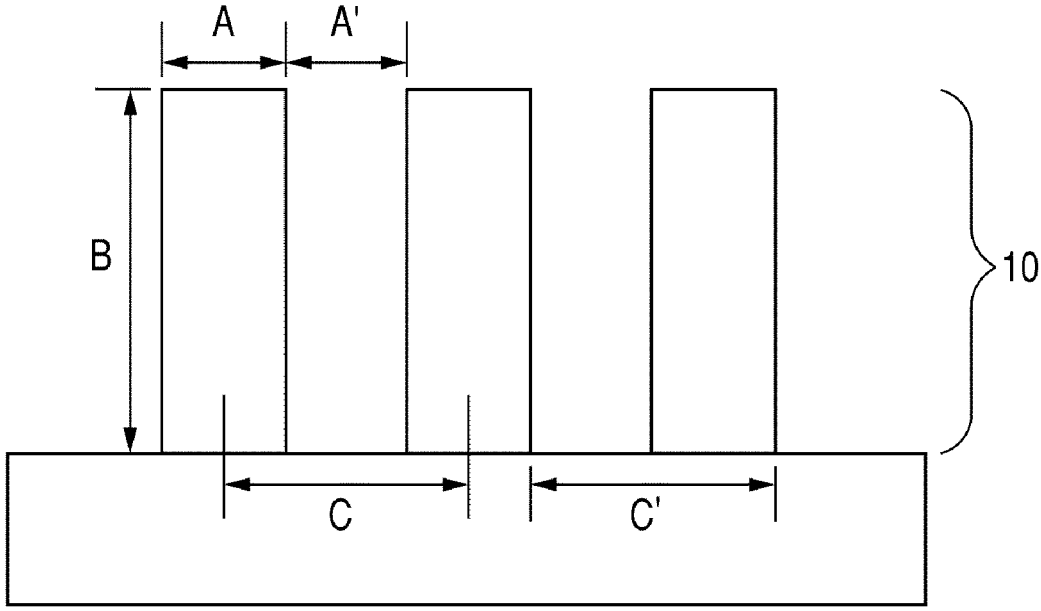
FIG. 5 is a schematic diagram for describing a pitch, a thickness (height) of a convex section, a width of a convex section, and an aperture width in a phase grating used in X-ray phase imaging.
Figure 6:
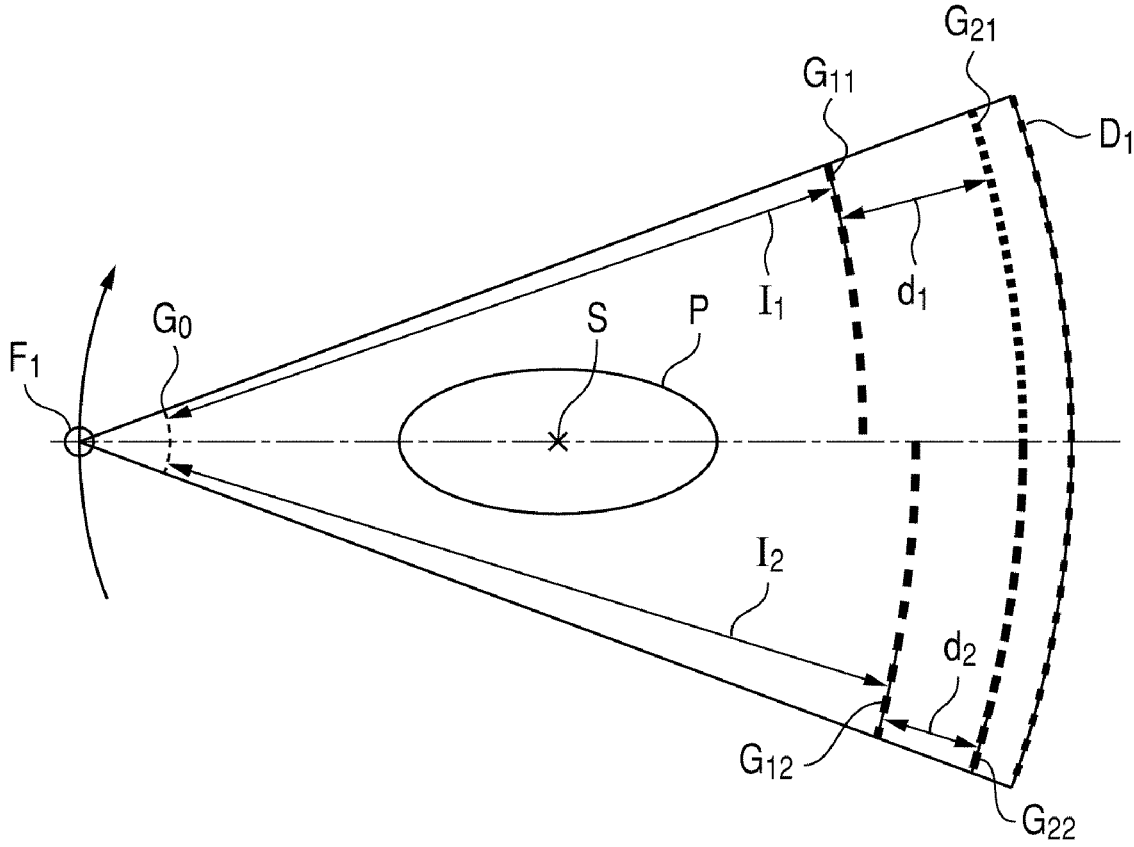
FIG. 6 is a diagram for describing Japanese Patent Application Laid-Open No. 2007-203074 as a conventional example.

In the present embodiment, the phase grating 1 includes a periodic structure 10 as illustrated in FIG. 5 in a plurality of different directions in the same surface.

The periodic structure has different periods, and a plurality of periodic intensity patterns formed by the periodic structure during X-ray irradiation are formed on the same plane.

In the phase grating of the present embodiment, the periodic structure denotes a structure in which linear and columnar structures parallel to each other are periodically arranged at constant intervals, and the periodic structure is constituted by a structure body in which there is a phase difference between X-ray transmitted through the structure and X-ray not transmitted through the structure.

The periodic structure may be formed on the surface of the substrate as a convex or a concave or may be embedded in the substrate.

Since absorption of X-ray can be reduced, the periodic structure can be a penetrating structure.

Figure 1:
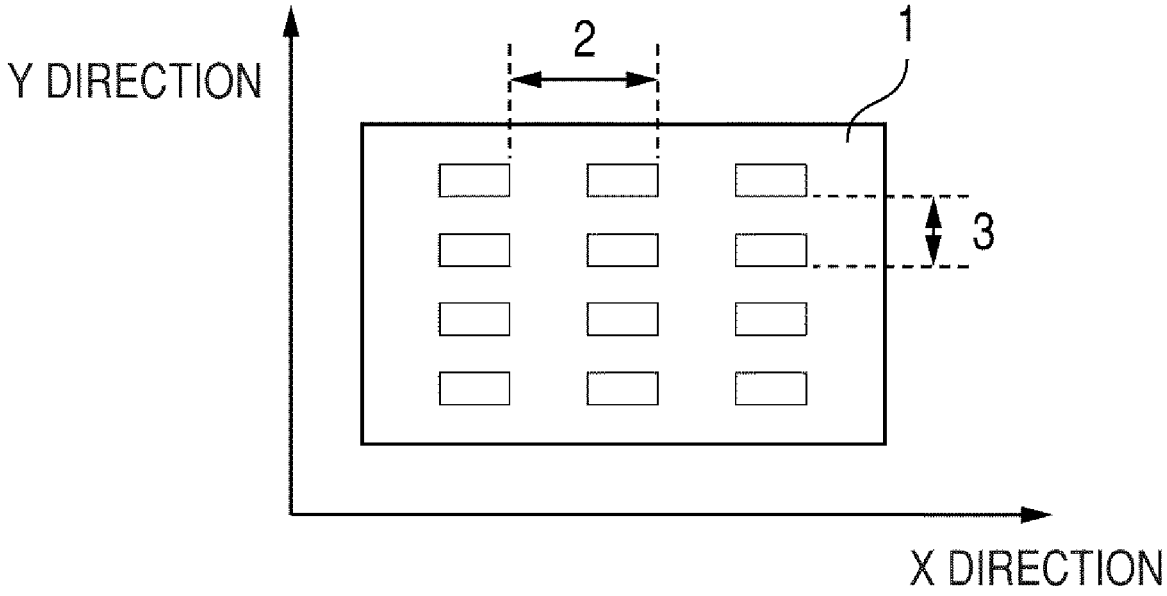
FIG. 1 is a diagram for describing an example of configuration of a phase grating used to take an X-ray phase contrast image according to an embodiment of the present invention.

FIG. 1 illustrates a phase grating surface in a direction perpendicular to a direction of the irradiation of X-ray.

A black section is a periodic structure of the phase grating 1. The periodic structure 10 as illustrated in FIG. 5 is formed in two types of directions, X and Y. As for the pitch (C or C') between the gratings described in FIG. 5, a pitch 2 in an X direction and a pitch 3 in a Y direction are different.

The phase grating may be manufactured by any material, and a material with less absorption of X-ray can be used to reduce the attenuation of the X-ray as much as possible during the irradiation of the X-ray.

For example, Si, GaAS, Ge, InP semiconductors and glass can be used.

Although the absorption of X-ray is greater than Si, resins, such as polycarbonate (PC), polyimide (PI), and polymethyl methacrylate (PMMA) can be used. When the periodic structure is formed on the surface of the substrate, the back side can be a mirror surface to improve the contrast.

To form the phase grating, a photolithographic method, a dry etching method, various deposition methods, such as sputtering, vapor deposition, CVD, electroless plating, and electroplating, a nanoimprint method and other methods can be used.

The substrate may be processed by dry etching or wet etching after the formation of the resist pattern by the photolithographic method, or the phase grating 1 can be provided on the substrate by a lift-off method.

The substrate or a material deposited on the substrate may be processed by the nanoimprint method.

The thickness of the periodic structure formed on the phase grating 1 can be a thickness in which the phase difference relative to the X-ray not transmitted through the periodic structure when a plurality of desired X-rays have transmitted through the periodic structure is $(2a-1)\times\pi$ or $(2a-1)\times(\pi/2)$ (a is an integer 1 or greater).

To minimize the absorption of X-ray by the periodic structure, the phase difference when the X-ray has transmitted through the periodic structure can be a combination of $\pi$ and $\pi/2$.

The thickness that changes the phase by $\pi$ is, for example, 22.6 μm for X-ray of 17.7 keV in the case of Si and is 45.3 μm for X-ray of 35 keV. To set the phase difference to $\pi$, the thickness can be set so that the periodic structure changes the phase by $3\pi$ or $5\pi$.

However, the thickness of the periodic structure is not limited to this, and the thickness can be any thickness if the X-ray directed to an area of the periodic structure is within a range of forming a self-image.

The desired X-ray transmitted through the periodic structure formed on the phase grating 1 forms a periodic intensity patterns with contrast corresponding to the distance from the phase grating 1.

The plurality of periodic structures formed on the phase grating 1 have pitches so that the self-images formed by the desired X-ray are formed on the same plane.

In radiation light, when the phase grating 1 becomes $\pi$ grating relative to X-ray with wavelength $\lambda_1$, the X-ray transmitted through the phase grating 1 forms a self-image at a location under the following condition.

$$((2m+1)/8)\times(d_1^2/\lambda_1)$$

When the phase grating 1 becomes $\pi/2$ grating relative to X-ray with wavelength $\lambda_2$, the X-ray transmitted through the phase grating 1 forms a self-image at a location under the following condition.

$$((2n+1)/2)\times(d_2^2/\lambda_2)$$

When $d_1$, $d_2$, $\lambda_1$, $\lambda_2$, m, and n are set to satisfy the following condition, the self-images are formed on the same plane.

$((2m+1)/8)\times(d_1^2/\lambda_1)=((2n+1)/2)\times(d_2^2/\lambda_2)$. In the condition, $d_1$ and $d_2$ denote pitches in different directions of the phase grating 1, $\lambda_1$ and $\lambda_2$ denote wavelengths of X-ray with two different wavelengths, and m and n denote integers.

At a first location where the X-ray with wavelength $\lambda_1$ forms a self-image, $d_1$, $d_2$, $\lambda_1$, $\lambda_2$, m, and n are set so that the contrast of the periodic intensity pattern formed by the X-ray with wavelength $\lambda_2$ is as low as possible.

Although the periodic structure of the phase grating 1 may be formed in three or more directions, the periodic structure formed on the phase grating 1 can be formed in two directions because the higher the contrast of the self-image obtained during irradiation of X-ray, the easier can the phase image of the subject 7 be obtained.

An example in which an X-ray phase contrast image is taken by radiation light in a phase grating formed by periodic structures orthogonal to each other in two directions will be described with reference to FIG. 2.

Figure 2:
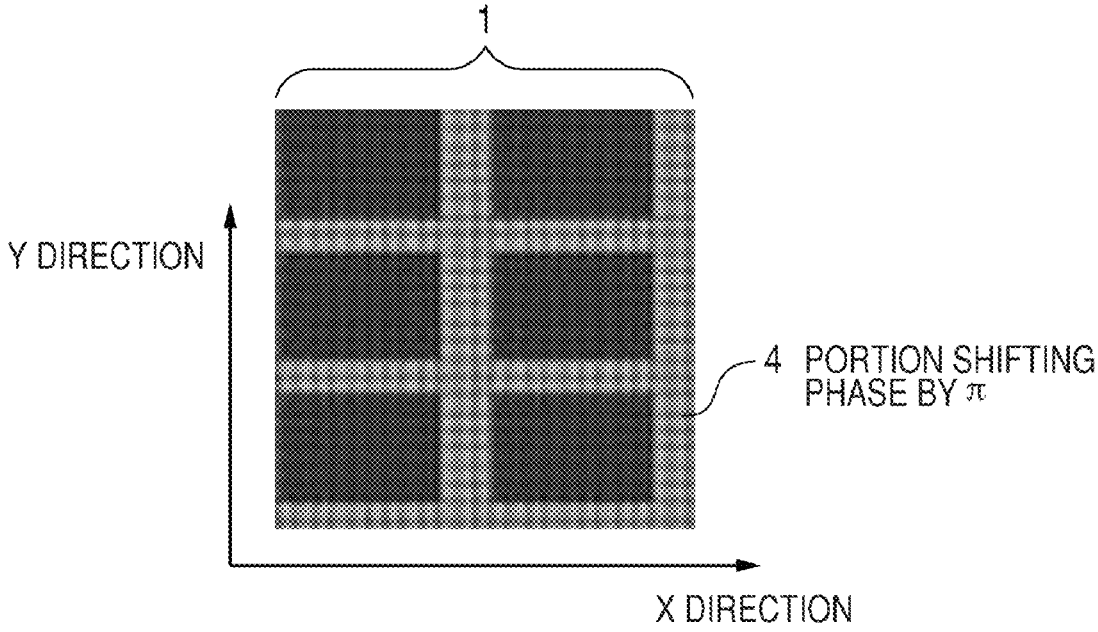
FIG. 2 is a diagram for describing an example according to the embodiment of the present invention, in which a phase grating formed by periodic structures orthogonal to each other in two directions is used, and an X-ray phase contrast image is taken by radiation light.

FIG. 2 illustrates a surface perpendicular to the directed X-ray in the phase grating 1.

It is set that the phase of the transmitted X-ray changes by $\pi$ in the light parts and the dark parts of FIG. 2. That is, in FIG. 2, the portion shifting the phase by $\pi$ is illustrated.

The ratio of the light part width to the dark part width is 1 to 3 in both X and Y directions.

The directed X-ray is parallel light. There are two types of energy of X-ray, 12.4 keV and 28.2 keV.

In this case, if the X-ray is directed to two types of one-dimensional phase gratings equivalent to the X-direction and Y-direction periods of the phase grating 1, self-images are formed at equal locations. Similarly, when the X-ray is directed to the phase grating illustrated in FIG. 2, two-dimensional periodic patterns reflecting the phase grating shape can be observed at the locations where the one-dimensional phase gratings form the self-images.

A simulation example of taking an X-ray phase contrast image by a white X-ray source of a point light source will be described with reference to FIG. 3.

Figure 3:
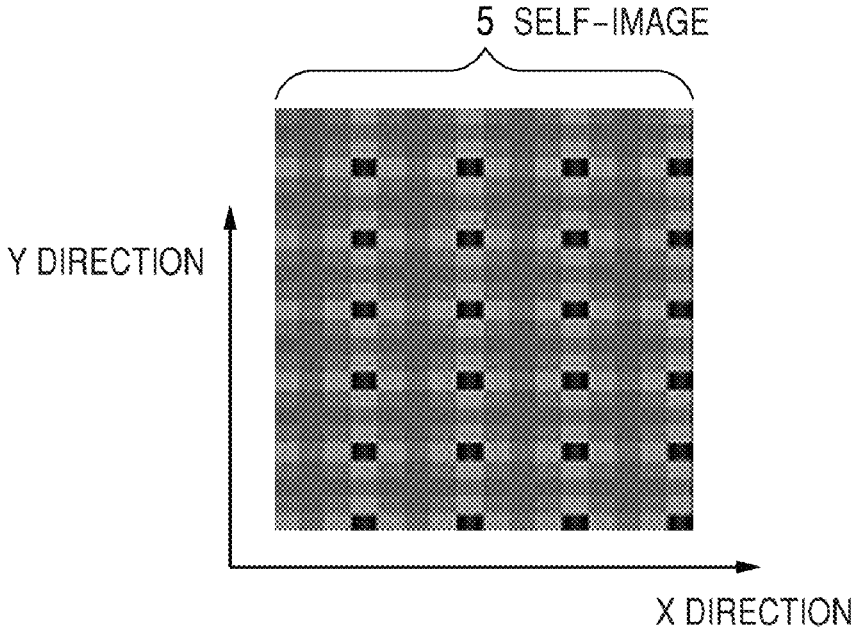
FIG. 3 is a diagram for describing an example according to the embodiment of the present invention, in which a phase grating formed to include periodic structures orthogonal to each other in two directions is used, and an X-ray phase contrast image is taken by a white X-ray source of a point light source.
Figure 4:
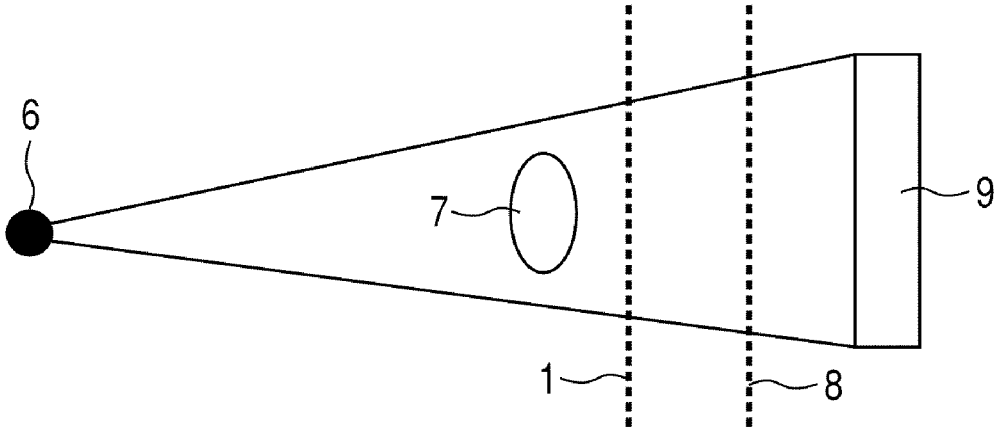
FIG. 4 is a diagram for describing a Talbot interferometer as a conventional example for obtaining an X-ray phase image.

FIG. 3 illustrates that the amount of X-ray transmission is greater at the parts closer to white.

In FIG. 3, light lines of ½ pitch of the periodic structures formed on the phase grating 1 are formed in the X and Y directions, and a light/dark periodic image corresponding to the pitch of the periodic structure formed on the phase grating 1 is obtained in the X and Y directions.

It can be recognized that a phase image can be obtained by X-ray with different energy using the phase gratings with different pitches in X and Y directions based on a set of the phase grating 1 and a phase grating 8.

Although continuous X-ray may be used to obtain the self-image, a self-image with higher contrast can be obtained using characteristic X-ray.

For example, the characteristic X-ray energy of Kα line of Mo is 17.5 keV and 20.2 keV.

X-rays with more than two types of energy may be directed at the same time, or the X-rays may be directed energy by energy to separately acquire the X-ray absorbed images.

To acquire the phase image of the subject 7, the self-image of the phase grating 1 at the time of subject imaging needs to be acquired.

To do so, there are a method of using the X-ray detector 9 with higher resolution than the line width of the self-image and a method of using the absorption grating 8 to use the X-ray detector 9 used in a conventional X-ray absorbing image.

When the absorption grating 8 is used, a shape of a combination of self-images formed by the periodic structures formed by the phase grating 1 in the direction perpendicular to the direction of the irradiation of X-ray is desirable.

The shape may be an enlarged or reduced shape of the combination of the self-images formed by the periodic structures.

The thickness of the absorption grating 8 is determined by the energy of the X-ray and the material of the absorption grating, and the amount of X-ray transmission can be set to 20% or less at the light shielding section.

A fringe scanning method is used to acquire the X-ray phase contrast images using the phase grating 1 and the absorption grating 8.

The fringe scanning method is a method of moving the phase grating 1 or the absorption grating 8 for a plurality of times within a single pitch of the periodic structure and acquiring three or more X-ray absorbed images to acquire an amount of change in the X-ray intensity relative to an amount of movement of the grating pixel by pixel.

The amount of phase change between pixels is equivalent to a differential phase image, and the integration in the direction of the movement of the periodic structure can obtain the phase contrast image.

In the present embodiment, the use of the phase grating in the imaging system of the X-ray phase contrast image can realize the imaging system capable of acquiring an X-ray phase contrast image by the phase grating in the same size as when a single wavelength is used.

An X-ray computer tomography system including the imaging system of the X-ray phase contrast image can also be realized.

EXAMPLES

Hereinafter, Examples of the present invention will be described.

Example 1

In Example 1, an example of configuration in which the phase grating 1 that has formed the periodic structures orthogonal to each other is used to take an X-ray phase contrast image by radiation light will be described.

In the present Example, resist coating is applied to a both-side polishing 200 μm thickness silicon wafer surface with 4-inch diameter, and then a resist pattern is created in an area of 60 mm square based on a photolithographic method.

The pitches of the resist pattern are different in the X and Y directions, and the resist pattern has a mesh structure in which the pattern in the X direction and the pattern in the Y direction are orthogonal.

More specifically, in the X direction, the resist pattern width has width 4 μm and aperture 4 μm. In the Y direction, the resist pattern has the line width 1.64 μm and space 1.64 μm.

Deep reactive ion etching (hereinafter, "Deep-RIE") is performed to remove Si until the depth is 22.6 μm at the resist aperture section.

The resist of the Si surface is then removed. The phase grating 1 is created by the foregoing processes.

The absorption grating 8 corresponding to the phase grating is then created.

Resist coating is applied to a both-side polishing 200 μm thickness silicon wafer surface with 4-inch diameter, and then a resist pattern is created in an area of 60 mm square based on a photolithographic method.

The resist pattern is a pattern including lines parallel to each other, and the resist pattern has the line width 0.82 μm and the space 2.46 μm.

Deep-RIE is performed to remove Si until the depth is 50 μm at the resist aperture section.

A vapor deposition method is then used to form Ti100 nm and Au200 nm on the Si surface.

Gold plating is performed based on Au formed by the vapor deposition. MICROFAB Au1101 manufactured by Electroplating Engineers of Japan Ltd. is used as a plating solution, and the paddle plating method is performed for 85 minutes at 65° C. The current density is set at 0.5 A/dm2

As a result, a gold layer with 0.82 μm thickness is formed on the surface of the Si substrate.

Similarly, a Si slit structure of width 2 μm and space 6 μm is formed, and a gold layer with 2 μm thickness is formed on the surface of the Si substrate.

Two Au-plated Si substrate formed by the method are set so that the formed slit patterns are rectangular, and two substrates are fixed by an adhesive to set the absorption grating 8. The phase grating 1 is set perpendicular to the incident light in the radiation light facility, and the absorption grating 8 is set in the opposite direction from the X-ray source 6 relative to the phase grating 1, at a location 114 mm away from the phase grating 1. At this point, the absorption grating 8 is also set perpendicular to the incident light. In the periodic structure 10 of the absorption grating 8 and the periodic structure 10 of the phase grating 1, equal pitches are set parallel.

The X-ray detector 9 is set in the opposite direction from the X-ray source relative to the absorption grating 8, at a location 5 mm away from the absorption grating.

An X-ray of 17.7 keV is then directed from a perpendicular structure of a wafer with the phase grating 1.

In this way, a self-image originated from an 8 μm pitch periodic structure 10 formed in the X direction of the phase grating 1 is formed in the X direction. Based on the self-image and the absorption grating 8, moire fringes can be observed by the X-ray detector 9 with a pixel pitch wider than the pitch of the absorption grating.

Meanwhile, the contrast of the X-ray periodic intensity pattern formed in the Y direction is lower than that in the X direction.

After setting the subject just in front of the phase grating, the X-ray transmission image corresponding to the fringe scanning method in the X direction are acquired to obtain a phase image formed by the X-ray of 17.7 keV.

An X-ray of 35.0 keV is then directed from the perpendicular structure of the wafer. As a result, a self-image originated from a 3.28 μm pitch periodic structure formed in the X direction of the phase grating is formed in the Y direction.

Based on the self-image and the absorption grating, observation is possible by the X-ray detector 9.

Meanwhile, the contrast of the X-ray periodic intensity pattern formed in the X direction is lower than that in the Y direction.

The fringe operation method in the Y direction can also realize the observation of the X-ray phase contrast image of the subject 7 by the X-ray of 35.0 keV, as in the case of 17.7 keV.

Example 2

In Example 2, an example of configuration of using the phase grating 1 that has formed the periodic structures 10 orthogonal to each other to take an X-ray phase contrast image by a minute white X-ray source 6 will be described.

The phase grating 1 is created in the same method as Example 1. The resist pattern width in the X direction has the width 4 μm and the space 4 μm, and the resist pattern width in the Y direction has the width 1.64 μm and the space 1.64 μm. The size of the X-ray source is 5 μm, and the target is Mo.

The phase grating 1 is set at a location 1000 mm away from the X-ray source 6.

When the X-ray is directed to the phase grating 1, the self-image formed by the periodic structures 10 in the X and Y directions is formed at a location 128 mm away from the phase grating 1 in the opposite direction from the X-ray source as seen from the phase grating 1.

The absorption grating 8 created in the same way as in Example 1 is set at a location where the self-image is formed. The absorption grating 8 has gold grating width 2.26 μm and space 2.26 μm in the X direction and gold grating width 0.93 μm and space 0.93 μm in the Y direction.

The X-ray detector 9 is further set in the opposite direction from the X-ray source relative to the absorption grating 8, at a location 5 mm away from the absorption grating 8.

After the installation of the subject 7, observation of the X-ray phase contrast image can be realized by acquiring the X-ray transmission image by the fringe operation method as in Example 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-234850, filed Oct. 9, 2009, which is hereby incorporated by reference herein in its entirety.

What is claimed is:

1. A phase grating used when an X-ray is directed to take an X-ray phase contrast image, comprising a periodic structure for generating a phase difference between an X-ray transmitted through the structure and an X-ray not transmitted through the structure, wherein the periodic structure has different periods in a plurality of directions in a same surface, wherein the periodic structure has a thickness so that a phase difference relative to the X-ray not transmitted through the periodic structure when the X-ray has transmitted through the periodic structure is $(2a-1)\times\pi$ or $(2a-1)\times(\pi/2)$, and wherein a is an integer one or greater.

2. The phase grating used to take an X-ray phase contrast image according to claim 1, wherein the periodic structure is formed by periodic structures orthogonal to each other in two directions.

3. A phase grating used when an X-ray is directed to take an X-ray phase contrast image, comprising a periodic structure for generating a phase difference between an X-ray transmitted through the structure and an X-ray not transmitted through the structure, wherein the periodic structure has different periods in a plurality of directions in a same surface, and wherein the periodic structure has a thickness so that a phase difference relative to the X-ray not transmitted through the periodic structure when the X-ray has transmitted through the periodic structure is $\pi$ in the case of employing X-ray with wavelength $\lambda_1$, or $\frac{1}{2}\pi$ in the case of employing X-ray with wavelength $\lambda_2$, the phase grating satisfies a condition $((2n+1)/2)$, a condition $((2m+1)/8)\times(d_1^2/\lambda_1)$ for an area including a periodic structure in which the phase of the X-ray transmitted through the phase grating periodically changes by $\pi$, the phase grating satisfies a condition $((2n+1)/2)\times(d_2^2/\lambda_2)$ for an area including a periodic structure in which the phase of the X-ray transmitted through the phase grating periodically changes by $\pi/2$, and a condition $((2m+1)/8)\times(d_1^2/\lambda_1)=((2n+1)/2)\times(d_2^2/\lambda_2)$ is satisfied, wherein $d_1$ and $d_2$ denote pitches in different directions of the phase grating 1, $\lambda_1$ and $\lambda_2$ denote wavelengths of X-ray with two different wavelengths, and m and n denote integers.

4. An imaging system of an X-ray phase contrast image, the imaging system comprising:

a phase grating; and a detector that detects an X-ray intensity distribution generated by the phase grating, wherein the phase grating comprises a periodic structure for generating a phase difference between an X-ray transmitted through the structure and an X-ray not transmitted through the structure, wherein the periodic structure has different periods in a plurality of directions in a same surface, wherein the periodic structure has a thickness so that a phase difference relative to the X-ray not transmitted through the periodic structure when the X-ray has transmitted through the periodic structure is $(2a-1)\times\pi$ or $(2a-1)\times(\pi/2)$, wherein a is an integer one or greater.

5. The imaging system of an X-ray phase contrast image according to claim 4, wherein a self-image formed by the periodic structure in the direction having pitch d1 and a self-image formed by the periodic structure in the direction having pitch d2 are formed on the same plane, and the detector detects intensity distribution of X-ray with wavelength $\lambda_1$ and intensity distribution of X-ray with wavelength $\lambda_2$.

6. The imaging system of an X-ray phase contrast image according to claim 4, wherein the periodic structure has a thickness so that a phase difference relative to the X-ray not transmitted through the periodic structure when the X-ray has transmitted through the periodic structure is $\pi$ in the case of employing X-ray with wavelength $\lambda_1$, or $\frac{1}{2}\pi$ in the case of employing X-ray with wavelength $\lambda_2$, and the detector detects intensity distribution of X-ray with wavelength $\lambda_1$ and intensity distribution of X-ray with wavelength $\lambda_2$.

7. The phase grating used to take an X-ray phase contrast image according to claim 6, wherein a condition $((2m+1)/8)\times(d_1^2/\lambda_1)=((2n+1)/2)\times(d_2^2/\lambda_2)$ is satisfied, and wherein $d_1$ and $d_2$ denote pitches in different directions of the phase grating, and m and n denote integers.

* * * * *